US005383610A

United States Patent [19]

Longhurst

[11] Patent Number: 5,383,610

[45] Date of Patent: Jan. 24, 1995

[54] METHOD OF OPERATING A MATERIAL BED ROLL MILL

[75] Inventor: Don Longhurst, Marietta, Ga.

[73] Assignee: Krupp Polysius AG, Beckum, Germany

[21] Appl. No.: 66,496

[22] Filed: May 24, 1993

[30] Foreign Application Priority Data

Jun. 17, 1992 [DE] Germany ..... 4219886

[51] Int. Cl.[6] ..... B02C 19/12

[52] U.S. Cl. ..... 241/30; 241/32; 241/37

[58] Field of Search ..... 241/30, 36, 101.3, 37, 241/32, 230–235; 340/679, 540; 364/468, 472, 473

[56] References Cited

U.S. PATENT DOCUMENTS

| | | | |
|---|---|---|---|
| 1,535,392 | 4/1925 | Ashton | 241/32 X |
| 2,173,460 | 7/1955 | Atkinson | 241/37 X |
| 3,099,406 | 7/1963 | Kautz | 241/32 |
| 3,122,992 | 3/1964 | Kautz | 241/32 X |
| 3,310,244 | 3/1967 | Ramo | 241/101.3 |
| 3,458,141 | 7/1969 | Lenz | 241/36 |
| 3,608,837 | 9/1971 | Panning | 241/36 |
| 4,074,866 | 2/1978 | Meder | 241/30 |
| 4,372,496 | 2/1983 | Maliszewski | 241/121 X |
| 4,487,044 | 12/1984 | Fapiano | 364/472 |
| 4,491,000 | 1/1985 | Dornbusch | 364/472 X |
| 4,619,407 | 10/1986 | Goldhammer | 241/30 |
| 4,712,743 | 12/1987 | Nordun | 241/30 |
| 4,759,509 | 7/1988 | Prairie | 241/121 |
| 4,973,001 | 11/1990 | Kastungschafer et al. | 241/37 |
| 5,154,364 | 10/1992 | Ketting | 241/37 |
| 5,199,657 | 4/1993 | Kastingschafert et al. | 241/235 |
| 5,203,188 | 4/1993 | Osgood et al. | 364/472 X |
| 5,226,604 | 7/1993 | Seiffert et al. | 241/30 |
| 5,253,816 | 10/1993 | Kastingschafter et al. | 241/227 |

FOREIGN PATENT DOCUMENTS

| | | | |
|---|---|---|---|
| 225056 | 7/1985 | German Dem. Rep. | 241/36 |
| 1148850 | 5/1963 | Germany | 241/36 |
| 1607573 | 12/1969 | Germany | 241/36 |
| 2132149 | 1/1973 | Germany | 241/32 |
| 3238630 | 4/1984 | Germany | 241/32 |
| 3732723 | 9/1988 | Germany | 241/36 |
| 3922638 | 1/1991 | Germany | 241/37 |
| 3930773 | 3/1991 | Germany | 241/37 |
| 310009 | 9/1955 | Switzerland | 241/32 |
| 1278017 | 12/1986 | U.S.S.R. | 241/36 |

OTHER PUBLICATIONS

Citation—Walter H. Duda, Cement-Data-Book, vol. 1, 3rd Edition, 1985, pp. 255 to 257.

*Primary Examiner*—Mark Rosenbaum
*Assistant Examiner*—Frances Han
*Attorney, Agent, or Firm*—Learman & McCulloch

[57] ABSTRACT

The invention relates to the comminution of brittle material for grinding in a material bed roll mill with two grinding rolls, in which the material for grinding is comminuted between the cylindrical surfaces of the grinding rolls by the application of a grinding force. In order to prevent damage to the roll surfaces due to excessively high surface pressures but to utilise the maximum capacity without exceeding it, the roll surface pressure is continuously monitored and when an upper limit is exceeded the pressure is reduced to a permissible value by reducing the grinding force.

8 Claims, 1 Drawing Sheet

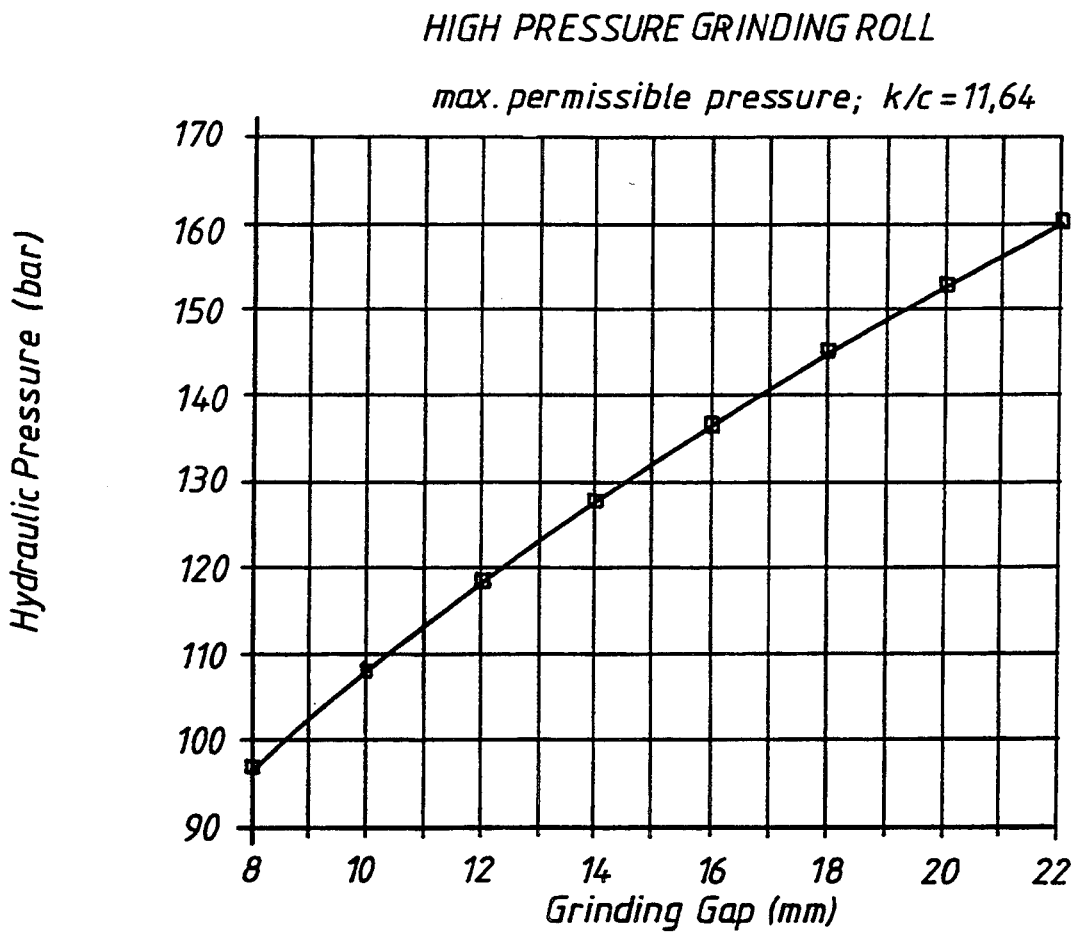
HIGH PRESSURE GRINDING ROLL
max. permissible pressure; k/c = 11,64
Hydraulic Pressure (bar)
170
160
150
140
130
120
110
100
90
8
10
12
14
16
18
20
22
Grinding Gap (mm)

METHOD OF OPERATING A MATERIAL BED ROLL MILL

The invention relates to a method of operating a material bed roll mill intended for the comminution of brittle material for grinding.

BACKGROUND OF THE INVENTION

Such methods of operating a material bed roll mill as well as material bed roll mills themselves are well known in the art and are described in the specialist literature, for example in Walter H. Duda, Cement-Data-Book, Vol. 1, 3rd Edition, 1985, pages 255 to 257.

In the comminution of brittle material for grinding (e.g. cement materials, ore materials, blast furnace slag or the like) is applied, for example with the aid of hydraulic pressure cylinders, to the two grinding rolls which are driven in opposite directions in such a way that the grinding rolls are pressed against one another at high pressure whilst maintaining a variable distance between these two grinding rolls. The material for grinding which is delivered is subjected to material bed comminution in this roll or grinding gap, and the comminuted material leaves this roll gap predominantly in the form of agglomerated scabs which are pressed together and are then broken up or disagglomerated in a separate operation.

In order to determine the output of such material bed roll mills it is also known to use or establish a series of fundamental figures, such as for example the roll diameter, the axial roll length, the circumferential velocity of the rolls, the drive power of the rolls, the grinding force applied to the grinding rolls, the scab thickness (and thus the width of the roll gap between the two grinding rolls) as well as the scab density. Therefore it is usual in the art to use these figures or the values resulting from them for the operation of a material bed roll mill and for control thereof.

However, in practice damage repeatedly occurs on the hard roll surface (roll shell) which can lead to undesirable stoppages of a material bed roll mill.

The object of the invention, therefore, is to provide a method by means of which the material bed roll mill has optimum output and the stoppages which can be attributed to damage to the roll surface can be largely avoided.

SUMMARY OF THE INVENTION

In the extensive studies on which the invention is based it was found that damage occurred on the hard roll surface and particularly increased in frequency when the grinding force exceeded a certain figure and thus the surface pressure in the roll gap exceeded certain maximum values. Using this knowledge, it is proposed according to the invention that as a function of a given roll surface quality the maximum permissible roll surface pressure is fixed, the roll surface pressure occurring on the roll surfaces is continuously monitored during the comminution operation and, at least when the maximum permissible roll surface pressure is exceed, an alarm signal is generated and after generation of this alarm signal the grinding force applied to the grinding rolls is reduced.

THE DRAWINGS

The sole drawing graphically illustrates the relationship between the maximum hydraulic pressure, $P_{hydr}$, and the grinding gap width, s.

DETAILED DESCRIPTION

As is known in the art, the quality of the hard roll surface of the rolls of a material bed roller mill, such as the type disclosed in U.S. Pat. No. 4,973,011 depends upon various factors, particularly the various hard materials which can be used, the manner of application of this surface material (e.g. by casting or deposit welding) or the construction and shape of the rolls (i.e. whether the roll has a segmented surface or segmented shell or is a solid roll). The maximum permissible roll surface pressure in the roll gap at which the material bed roll mill may operate is fixed as a function of this roll surface quality, using amongst other things empirical values determined in practice as well as optimum operating pressures in the efficiency of the material bed roll mill. This maximum permissible roll surface pressure is then used as a pressure setting value for the operational control of the roll mill, so that during the entire comminution operation of the material bed roll mill the roll surface pressure which occurs on the roll surfaces and fluctuates frequently due to various influences can be continuously monitored. At least when the preset maximum permissible roll surface pressure is exceeded an alarm signal is generated by means of which the grinding force can be at least temporarily reduced until the occurrence causing the maximum roll surface pressure to be exceeded is cleared and the roll mill can be switched back to its optimum grinding force.

Using this method according to the invention it is possible with a high degree of reliability to prevent damage to the hard roll surface due to a—possibly only temporarily—increased roll surface pressure and thus an undesirable shutdown of operation.

In practice this may mean, for example, that grinding rolls in which the surface or shell is produced by hard material deposit welding, in which certain welding defects cannot always be completely avoided, can on the one hand be operated at an optimum operational pressure defined by the maximum permissible roll surface pressure and on the other hand because of the monitoring of this roll surface pressure it is always possible to intervene to control the grinding force when there is a danger of damage to the roll surface due to an excessively high roll surface pressure.

When an alarm signal occurs it is possible per se to change, i.e. reduce, the grinding force applied to the grinding rolls by manual intervention on the part of the operating staff. However, it is more reliable if the grinding force applied to the grinding rolls is reduced temporarily, i.e. at least until the occurrence causing the maximum roll surface pressure to be exceeded is cleared, via a pressure medium control circuit by the alarm signal which is generated when the maximum permissible roll surface pressure is reached or exceeded.

However, it can also happen in practice that the maximum roll surface pressure is exceeded during the comminution operation only during a brief moment, for example a correspondingly large foreign body (e.g. a piece of metal) which cannot be crushed passes through the roll gap. In order not to bring about any unnecessary adjustment of the grinding force in such cases it is advantageous if the control signal is generated only after a set (time-delayed) alarm period has elapsed.

However, if due to disruptions or damage in the pressure medium system the grinding force applied to the grinding rolls and thus the resulting maximum permissible roll surface pressure are exceeded more persistently, the grinding force is reduced by means of the alarm signal and the pressure medium control circuit in the aforementioned manner. In the case of a persistent alarm signal this can first of all at least in one stage control the supply of pressure medium to the pressure medium cylinders which act on the grinding rolls to produce the grinding force so as to bleed pressure medium, whereby the grinding force is then correspondingly reduced. However, if this is not sufficient and the alarm signal continues, the drive for the grinding rolls and/or the material supply can be shut off in order to seek out and eliminate the cause of the undesirable increase in pressure. In this connection it is possible to proceed as follows in practical comminution operation: if the set maximum surface pressure value is reached, the hydraulic pumps can be switched on to change the pressure; if after a set time the maximum permissible surface pressure is still in the alarm triggering range or above it, the supply of pressure medium to the hydraulic cylinders is set to a reduced pressure by means of the pressure medium control circuit; only when the alarm signal still continues and a set upper safety pressure value is exceeded, the drive for the grinding rolls and/or the material supply can also be switched off.

It was possible to confirm by experiments that by this monitoring and control according to the invention of the maximum permissible roll surface pressure or the grinding force applied to the grinding rolls it is possible in a relatively simple and very reliable manner to ensure almost completely that the grinding rolls are prevented from being operated with a surface pressure in the roll gap at which damage to the grinding rolls occurs which is attributable to the surface quality. It was also shown that in this way the material bed roll mill can be operated with optimum efficiency.

Reliable means for continuous direct measurement of the roll surface pressure do not exist at present.

Therefore, according to the invention the roll surface pressure (pm in MPa) which acts during operation is determined taking account of at least the following values:

grinding force F (kN)
roll diameter D (mm)
length of grinding gap L (mm)
width of grinding gap s (mm)
compression gradient c $$pm = \frac{F}{D * L * c * \sqrt{s}} \quad (1)$$

The compression gradient is determined empirically, e.g. by bench tests, and the grinding force F is determined from the measured pressure $P_{hydr}$ of the pressure medium and the effective surface (e.g. the surfaces of the hydraulic pistons).

If the structural dimensions which do not alter in a given machine are put together to form a constant k, then $$pm = \frac{P_{hydr}}{c \times \sqrt{s}} \times k \quad (2)$$

and thus can be continuously determined during operation with the aid of a convenient computer program.

If an upper limit is fixed for pm, then the maximum permissible pressure medium pressure for the particular grinding gap widths can be fixed for a specific machine size and a specific material for grinding. The drawing shows such a curve.

I claim:

1. In a method of comminuting brittle material in a gap between confronting surfaces of a pair of contrarotating grinding rolls that are urged relatively toward one another under a predetermined optimum grinding force so as to crush and at least partially agglomerate a quantity of the brittle material passing through said gap, the improvement comprising:

constantly measuring surface pressure to which said rolls are subjected during comminution of the material;

comparing the measured surface pressure to a selected optimum surface pressure value;

at least temporarily reducing the grinding force applied to the rolls when the selected optimum surface pressure value is exceeded while continuing operation of the rolls until such time as the measured surface pressure no longer exceeds said selected optimum surface pressure value; and thereafter restoring the optimum grinding force to the rolls.

2. The method of claim 1 including reducing the grinding force only after a predetermined time period has elapsed.

3. The method of claim 1 including terminating the application of the grinding force to the rolls if the selected optimum surface pressure value is exceeded for a selected time period.

4. The method of claim 1 including stopping rotation of the grinding rolls if the selected optimum surface pressure value is exceeded for a selected time period.

5. The method of claim 1 including stopping the supply of material to said gap if the selected optimum surface pressure value is exceeded for a selected time period.

6. The method of claim 1 including stopping the rotation of the grinding rolls and the supply of material to the gap if the selected optimum surface pressure value is exceeded for a selected time period.

7. The method of claim 1 including applying the grinding force by a pressure medium control circuit.

8. The method of claim 7 including measuring the roll surface pressure, pm, according to the formula:

$$pm = \frac{P_{hydr}}{c \times \sqrt{s}} \times k$$

wherein, $P_{hydr}$ is the fluid pressure within the pressure medium control circuit;

c is an empirically derived compression gradient;

s is the width of the gap; and k is a constant.

* * * * *